US009518350B2

(12) United States Patent
Dokonal et al.

(10) Patent No.: US 9,518,350 B2
(45) Date of Patent: Dec. 13, 2016

(54) METHOD, SYSTEM, AND DEVICE FOR ADJUSTING OPERATION OF WASHING MACHINE BASED ON SYSTEM MODELING

(71) Applicant: Whirlpool Corporation, Benton Harbor, MI (US)

(72) Inventors: Luiz Von Dokonal, Joinville (BR); Fernando A. Ribas Junior, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 762 days.

(21) Appl. No.: 13/736,134

(22) Filed: Jan. 8, 2013

(65) Prior Publication Data

US 2014/0189959 A1 Jul. 10, 2014

(51) Int. Cl.

| | |
|---|---|
| ***D06F 35/00*** | (2006.01) |
| ***D06F 33/02*** | (2006.01) |
| ***D06F 39/00*** | (2006.01) |
| ***D06F 39/04*** | (2006.01) |

(52) U.S. Cl.

CPC ..... *D06F 35/006* (2013.01); *D06F 33/02* (2013.01); *D06F 39/003* (2013.01); *D06F 39/005* (2013.01); *D06F 39/045* (2013.01)

(58) Field of Classification Search

CPC ..... D06F 33/02; D06F 35/006; D06F 39/003; D06F 39/005; D06F 39/045

See application file for complete search history.

(56) References Cited

U.S. PATENT DOCUMENTS

| | | | |
|---|---|---|---|
| 5,459,386 | A | 10/1995 | Okachi et al. |
| 6,269,666 | B1 | 8/2001 | Whah et al. |
| 6,418,581 | B1 | 7/2002 | Bruce et al. |
| 6,546,354 | B1 | 4/2003 | Gayme |
| 6,634,048 | B1 | 10/2003 | Hornung et al. |
| 6,687,572 | B2 | 2/2004 | Stalsberg et al. |
| 6,691,536 | B2 | 2/2004 | Severns et al. |
| 6,715,175 | B2 | 4/2004 | Ciancimino et al. |

(Continued)

FOREIGN PATENT DOCUMENTS

WO 2010095866 A1 8/2010

OTHER PUBLICATIONS

European Search Report for Corresponding EP13198850.3, May 8, 2014.

*Primary Examiner* — Joseph L Perrin

(57) ABSTRACT

Devices and methods to adjust the operation of a washing machine based on system modeling include a motor, a control board, a heater, a number of sensors, and an electronic controller. The controller receives a selected wash cycle program and determines an operating condition of the selected wash cycle program, using data from the sensors. The motor may be used as a sensor. Based on the operating condition, the controller predicts an operational parameter of the washing machine using a system model. The controller may adjust the wash cycle program to keep the operational parameter in bounds or increase efficiency. The operational parameter may be temperature, electrical current consumption, wash efficiency, or energy consumption. The wash cycle program may be adjusted by modifying the duty cycle of the motor or the heater. The system model may be recalibrated upon use to adapt to the particular characteristics of the washing machine.

15 Claims, 6 Drawing Sheets

(56) References Cited

U.S. PATENT DOCUMENTS

| | | | | |
|---|---|---|---|---|
| 7,276,877 | B2 | 10/2007 | Qiu et al. | |
| 7,299,515 | B2 | 11/2007 | Oh et al. | |
| 7,813,831 | B2 | 10/2010 | McCoy et al. | |
| 7,936,146 | B2 | 5/2011 | Hida et al. | |
| 8,035,332 | B2 | 10/2011 | Filippa et al. | |
| 8,051,381 | B2 | 11/2011 | Ebrom et al. | |
| 8,102,140 | B2 | 1/2012 | Gao et al. | |
| 8,209,062 | B2 | 6/2012 | Andrews et al. | |
| 2006/0021392 | A1* | 2/2006 | Hosoito | D06F 33/02 68/12.04 |
| 2006/0207299 | A1* | 9/2006 | Okazaki | D06F 39/003 68/12.02 |
| 2009/0066284 | A1* | 3/2009 | Lee | D06F 37/42 318/473 |
| 2010/0045226 | A1* | 2/2010 | Kim | D06F 37/304 318/490 |
| 2010/0146712 | A1 | 6/2010 | Finch et al. | |
| 2010/0275953 | A1* | 11/2010 | Orue Orue | D06F 33/02 134/18 |
| 2012/0089258 | A1 | 4/2012 | Wong et al. | |
| 2012/0090099 | A1 | 4/2012 | Kim et al. | |

* cited by examiner

METHOD, SYSTEM, AND DEVICE FOR ADJUSTING OPERATION OF WASHING MACHINE BASED ON SYSTEM MODELING

TECHNICAL FIELD

The present disclosure relates generally to a method for controlling a washing machine, and, more particularly, to a method for adapting the wash cycle of a washing machine to change the performance of the washing machine.

BACKGROUND

A washing machine is a domestic appliance for cleaning clothes, linens, and other laundry. A washing machine may include a tub and a drum positioned in the tub that is sized to receive laundry for cleaning. The washing machine may include an electric motor that causes the drum to rotate relative to the tub during a washing operation. The washing machine may also include a heater to heat water during the washing operation. Both the motor and the heater require electrical current to operate. Typically, the motor and the heater are selected such that when both components are turned on at the same time, their combined current draw does not exceed a maximum current consumption for the washing machine.

Control systems for washing machines are typically reactive, responding to measurements relating to washing machine operation as those measurements are received. Such reactive control systems may abruptly interrupt operation of the washing machine, which is noticeable by the user. For example, a control system may monitor motor temperature and turn off the motor when a maximum motor temperature is exceeded. In another example, a control system may monitor current consumption of the washing machine and stop the current wash cycle if the maximum current consumption is exceeded.

SUMMARY

According to one aspect, a method for controlling operation of a washing machine during a wash cycle is disclosed. The method includes receiving a selected wash cycle program of a plurality of pre-programmed wash cycles, operating the washing machine in accordance with the selected wash cycle program, determining an operating condition when operating the washing machine, modeling the selected wash cycle program based on the operating condition to predict a value of an operational parameter of the washing machine, adjusting the selected wash cycle program based on the predicted value of the operational parameter, and operating the washing machine in accordance with the adjusted wash cycle program.

In some embodiments, determining the operating condition of the selected wash cycle program may include receiving data from a sensor of the washing machine, modeling the selected wash cycle program may include determining a predicted value of the operational parameter based on the received data and determining whether the predicted value of the operational parameter is within an accepted operational range of the washing machine, and adjusting the selected wash cycle program may include modifying the selected wash cycle program when the predicted value of the operational parameter is outside of the accepted operational range and maintaining the selected wash cycle program when the predicted value of the operational parameter is within the accepted operational range.

In some embodiments, modeling the selected wash cycle program may include determining a predicted operating temperature of a washing machine motor and determining whether the predicted operating temperature exceeds a maximum safe temperature of the motor, and adjusting the selected wash cycle program may include modifying a duty cycle of the motor to lower the predicted operating temperature of the motor to below the maximum safe temperature of the motor.

In some embodiments, receiving data from the sensor of the washing machine may include receiving load data, and determining the predicted operating temperature of the motor may include predicting the operating temperature based on the load data and the selected wash cycle program. In some embodiments, receiving data from the sensor further may include receiving ambient temperature data from a temperature sensor of the washing machine and determining the predicted operating temperature of the motor may include predicting the operating temperature based on the load data, the selected wash cycle program, and the ambient temperature data. In some embodiments, receiving data from the sensor may include receiving electrical current consumption data for the motor, and determining the predicted operating temperature of the motor may include predicting the operating temperature based on the electrical current consumption data.

In some embodiments, modeling the selected wash cycle program may include determining a predicted electrical current consumption of the washing machine and determining whether the predicted electrical current consumption exceeds a maximum safe electrical current consumption of the washing machine, and adjusting the selected wash cycle program may include modifying at least one of a duty cycle of a washing machine motor and a duty cycle of a heater of the washing machine to lower the predicted electrical current consumption to below the maximum safe electrical current consumption of the washing machine.

In some embodiments, modeling the selected wash cycle program may include determining a predicted operating temperature of a washing machine control board and determining whether the predicted operating temperature exceeds a maximum safe temperature of the control board, and adjusting the selected wash cycle program may include modifying a duty cycle of the motor to lower the predicted operating temperature of the control board to below the maximum safe temperature of the control board.

In some embodiments, modeling the selected wash cycle program further may include determining whether the predicted value of the operational parameter can be modified to meet an efficiency goal when the predicted value is within the accepted operational range and modifying the selected wash cycle program to improve performance related to the efficiency goal when the predicted value can be modified to meet the efficiency goal.

In some embodiments, determining a predicted value of the operational parameter based on the received data may include determining a predicted energy consumption of a washing machine motor, and modifying the selected wash cycle program may include modifying a duty cycle of the motor to reduce the predicted energy consumption of the motor.

In some embodiments, receiving data from the sensor of the washing machine may include receiving ambient temperature data from a temperature sensor of the washing machine, and receiving load data for the washing machine, determining the predicted value of the operational parameter may include determining a predicted cleaning effectiveness of the selected wash cycle program based on the ambient temperature data and the load data, and modifying the selected wash cycle program further may include modifying the selected wash cycle program to increase the predicted cleaning effectiveness of the selected wash cycle program.

In some embodiments, receiving data from the sensor of the washing machine may include receiving ambient temperature data from a temperature sensor of the washing machine and receiving load data for the washing machine, predicting the value of the operational parameter may include determining a predicted water heat rise produced by a heater of the washing machine based on the ambient temperature data and the load data, and modifying the selected wash cycle program may include modifying a duty cycle of the heater to reduce the predicted water heat rise.

In some embodiments, the method further may include optimizing the selected wash cycle program by modeling the selected wash cycle program for a first time period of the wash cycle, modifying the selected wash cycle program to produce a first modified wash cycle program, modeling the first modified wash cycle program for a second time period of the wash cycle, the second time period after the first time period, and modifying the first modified wash cycle program to produce a second modified wash cycle program.

In some embodiments, the method further may include recalibrating a system model based on the received data, the predicted value of the operational parameter, and the adjusted wash cycle program to reduce a prediction error of the system model using one of a proportional-integral controller, a proportional-integral-derivative controller, and a simulated neural network embedded in the washing machine.

According to another aspect, a washing machine is disclosed. The washing machine includes a motor operable to rotate a wash drum configured to receive laundry, a heater operable to heat wash water in the wash drum, a plurality of sensors, each sensor being operable to generate data indicative of an operating condition of the washing machine, and an electronic controller electrically coupled to the motor, the heater, and the plurality of sensors. The electronic controller includes a processor and a memory device. The memory device has stored therein a plurality of instructions which, when executed by the processor, cause the processor to receive a selected wash cycle program, determine the operating condition of the selected wash cycle program when the washing machine is operating the selected wash cycle program, model the selected wash cycle program based on the operating condition to predict a value of an operational parameter, adjust the selected wash cycle program based on the predicted value of the operational parameter, and operate the washing machine in accordance with the adjusted wash cycle program.

In some embodiments, the plurality of sensors may include a load sensor configured to transmit load data, a temperature sensor configured to transmit ambient temperature data indicative of an ambient temperature of the washing machine to the electronic controller, and a current sensor configured to transmit electrical current consumption data indicative of an electrical current consumption of the motor.

In some embodiments, the washing machine further may include a plurality of instructions, which when executed by the processor, further cause the processor to receive sensor data from at least one sensor of the plurality of sensors, determine a predicted operating temperature of the motor based on the sensor data and the selected wash cycle program, determine whether the predicted operating temperature exceeds a maximum safe temperature of the motor, and modify a duty cycle of the motor to lower the predicted operating temperature to below the maximum safe temperature of the motor when the predicted operating temperature exceeds the maximum safe temperature of the motor.

In some embodiments, the washing machine further may include a plurality of instructions, which when executed by the processor, further cause the processor to receive the load data and the ambient temperature data, determine a predicted electrical current consumption of the washing machine based on the ambient temperature data, the load data, and the selected wash cycle program, determine whether the predicted electrical current consumption exceeds a maximum safe electrical current consumption of the washing machine, and modify at least one of a duty cycle of the motor and a duty cycle of the heater to reduce the predicted electrical current consumption below the maximum safe electrical current consumption of the washing machine.

In some embodiments, the washing machine further may include a plurality of instructions, which when executed by the processor, further cause the processor to receive the load data and the ambient temperature data from the plurality of sensors, determine a predicted energy consumption of the washing machine based on the ambient temperature data, the load data, and the selected wash cycle program, determine whether the predicted energy consumption is greater than a target energy consumption of the washing machine, and modify at least one of: a duty cycle of the motor and a duty cycle of the heater to reduce the predicted energy consumption to below the target energy consumption.

According to another aspect, a method for controlling operation of a washing machine during a wash cycle is disclosed. The method includes receiving a selected wash cycle program of a plurality of pre-programmed wash cycles, operating the washing machine in accordance with the selected wash cycle program, determining an operating condition when operating the washing machine, modeling the selected wash cycle program based on the operating condition to predict a value of an operational parameter of the washing machine, determining whether the predicted value of the operational parameter exceeds an efficiency goal of the washing machine, adjusting the selected wash cycle program based on the predicted value of the operational parameter when the predicted value exceeds the efficiency goal, and operating the washing machine in accordance with the adjusted wash cycle program.

BRIEF DESCRIPTION OF THE DRAWINGS

The detailed description particularly refers to the following figures, in which.

DETAILED DESCRIPTION OF THE DRAWINGS

Figure 1:
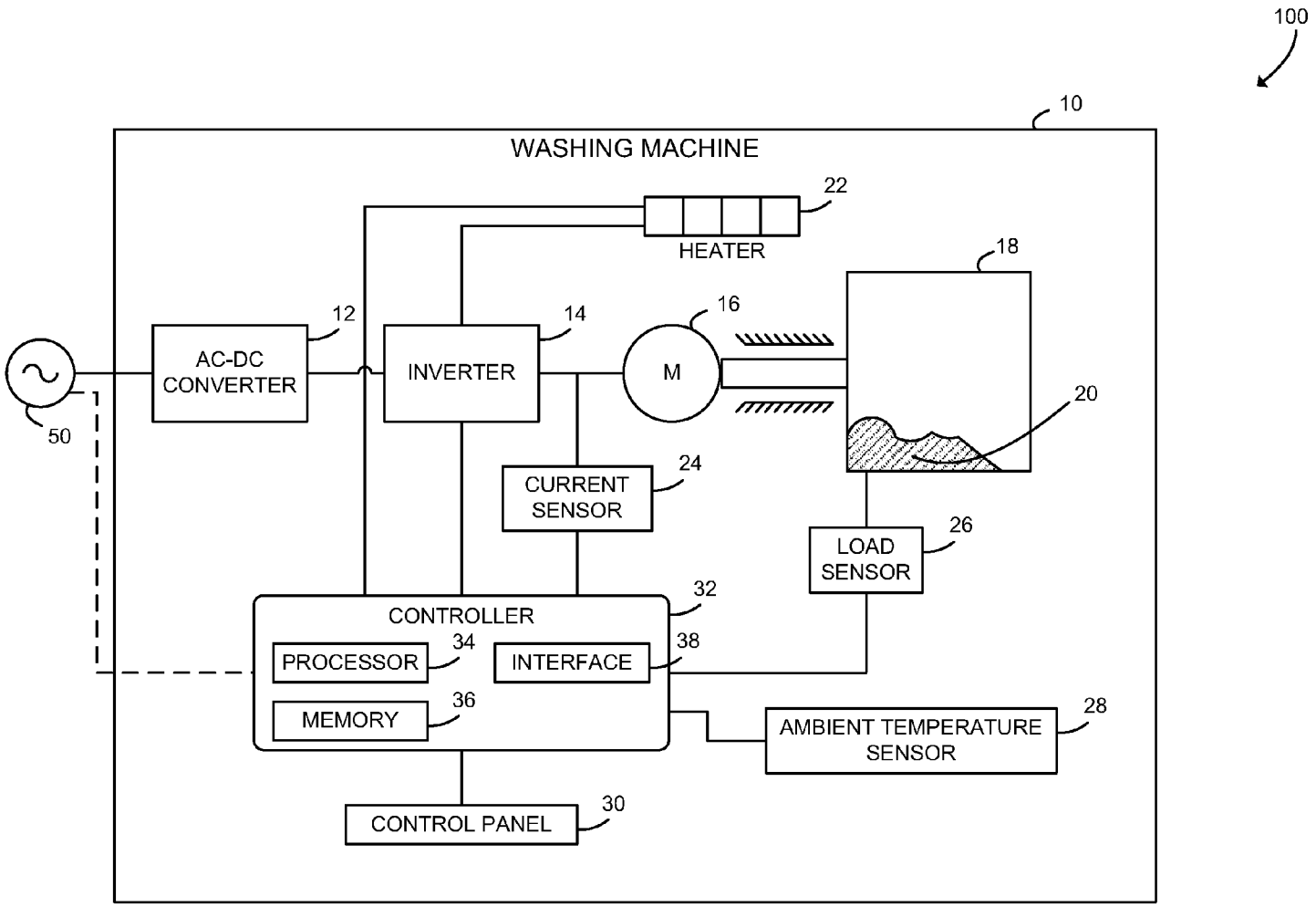
FIG. 1 is a simplified block diagram of a washing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Embodiments of the disclosed systems and methods may be implemented in hardware, firmware, software, or any combination thereof. Embodiments of the disclosed systems and methods implemented in a washing machine may include one or more point-to-point interconnects between components and/or one or more bus-based interconnects between components. Embodiments of the disclosed systems and methods may also be implemented as instructions stored on one or more non-transitory, machine-readable media, which may be read and executed by an electronic control unit. A non-transitory, machine-readable medium may include any mechanism for storing or transmitting information in a form readable by a machine (e.g., a processor). For example, non-transitory, machine-readable media may include read only memory (ROM), random access memory (RAM), magnetic disk storage, optical storage, flash memory, and/or other types of memory devices.

Referring now to FIG. 1, a washing machine 10 is shown in simplified block diagram. In some embodiments, the washing machine 10 may include additional and/or different components than those shown in FIG. 1 and described herein. The washing machine 10 includes an AC-DC converter 12. The AC-DC converter 12 of the washing machine 10 is electrically coupled to an external AC mains power supply 50. The AC-DC converter 12 is a power regulating circuit that transforms AC mains power (e.g., 240 V, 60 Hz) into direct current (DC) power and supplies this DC to the other components of the washing machine 10. In the illustrative washing machine 10, the AC-DC converter 12 is embodied as a rectifier.

The AC-DC converter 12 is electrically coupled to an inverter 14. The inverter 14 is operable to convert the DC power supplied by the AC-DC converter 12 into AC power usable by the internal components of the washing machine 10. The inverter 14 includes a plurality of switching elements electrically operable to produce output AC power. The switching elements are insulated-gate bipolar transistors (IGBTs), but may be metal-oxide-semiconductor field-effect transistors (MOSFETs) or other switching devices in other embodiments. In some embodiments, some or all of the components of the AC-DC converter 12 and/or the inverter 14 may be included on a control board of the washing machine 10 (not illustrated).

The inverter 14 is electrically coupled to a motor 16. The motor 16 is a permanent magnet synchronous motor (also known as a brushless, alternating current (AC) motor). The motor 16 includes a stator, a rotor configured to rotate relative to the stator, a plurality of stator field coils, and one or more permanent magnets. Each stator field coil of the motor 16 is separately electrically connected to the inverter 14. During operation, the inverter 14 supplies AC power of the same frequency but with different phase to each stator field coil of the motor 16. The multi-phased AC power flows through the stator field coils of the motor 16 to produce a rotating magnetic field; that is, the direction of the combined magnetic field produced by the plurality of stator field coils rotates. This rotating magnetic field interacts with the one or more permanent magnets and causes the rotor to rotate. In other embodiments, a different type of electric motor may be used, for example, an AC induction motor or a switched reluctance motor.

The motor 16 is connected to a drum 18 via a driveshaft. The drum 18 includes a cavity that is sized to receive clothes and other laundry 20 to be washed in the washing machine 10. The drum 18 may be formed from metallic materials, such as, for example, steel, or from polymeric materials, such as, for example, a rigid plastic resin. The motor 16 is operable to rotate the drum 18 about a rotational axis. It should be appreciated that in other embodiments the motor 16 may be connected indirectly to the drum 18 via a transmission system. In some embodiments, the transmission system may include a number of pulleys and belts or a gear assembly that is configured to translate the rotary motion of the motor 16 into rotational movement for the drum 18.

In the illustrative embodiment, the washing machine 10 is a front-loaded machine in which the drum 18 is accessed through an opening defined in the front of the washing machine 10. It should be appreciated that in other embodiments the washing machine 10 may have other configurations. For example, the washing machine 10 may be a top-loaded machine in which the drum 18 is accessed through an opening defined in the top of the washing machine 10. Further, in the illustrative embodiment the rotational axis of the drum 18 is horizontal. It should be appreciated that the rotational axis may have other configurations; for example, the rotational axis may be vertical.

The washing machine 10 includes a heater 22 electrically coupled to the inverter 14. The heater 22 is operable to heat wash water inside the drum 18. The heater 22 includes a resistive heating element operable to convert AC power supplied by the inverter 14 into heat. The power consumption and associated heat output of the heater 22 may be controlled through pulse-width modulation of the input AC power. In other embodiments, the heater 22 may include two or more resistive heat elements. In such embodiments, the power consumption and heat output of the heater 22 may be controlled through selectively energizing the resistive heating elements.

The washing machine 10 includes a current sensor 24 electrically coupled to the inverter 14 and the motor 16. The current sensor 24 is configured to generate signals representative of the electrical current supplied by the inverter 14 to the motor 16. The current sensor 24 may be embodied as a shunt resistor, Hall effect sensor, or other current-measuring component. Although illustrated as a single component, the current sensor 24 may include multiple current-measuring components. For example, the current sensor 24 may include one current-measuring component for each stator field coil of the motor 16. The current sensor 24 is electrically coupled to an electronic controller 32, described in detail below.

The washing machine 10 includes a load sensor 26 configured to generate signals representative of the amount of laundry and wash water loaded inside of the drum 18. The load sensor 26 may be a physical displacement sensor attached to the drum 18. The weight of the load causes the drum 18 to move down slightly. This displacement is proportional to the amount of laundry and wash water inside the drum 18. In other embodiments, the load sensor 26 may be integrated in other components of the washing machine 10 or software based. For example, the load sensor 26 may measure water level in the drum 18 or may measure motor torque to determine the amount of laundry and wash water inside of the drum 18. The load sensor 26 may also determine the type of fabric loaded inside of the drum 18 based the weight of the load or on the amount of water absorbed by the laundry. The load sensor 26 is also electrically coupled to the controller 32.

The washing machine 10 includes an ambient temperature sensor 28 configured to generate signals representative of the ambient temperature of the washing machine 10. The ambient temperature sensor 28 is a thermocouple. In other embodiments, the ambient temperature sensor 28 may be integrated in other components of the washing machine 10 or software based. For example, ambient temperature may be determined through measurement of the initial resistance of the stator field coils of the motor 16. The temperature of the motor 16 may be calculated based on this resistance, and the ambient temperature may be calculated based on the temperature of the motor 16. In some embodiments, the ambient temperature may be calculated based on any deviation between the temperature of the motor and a predicted temperature of the motor, which prediction is described in more detail below in relation to FIG. 2. The ambient temperature sensor 28 is also electrically coupled to the controller 32.

Although the illustrated embodiment includes discrete current sensor 24, load sensor 26, and ambient temperature sensor 28, in some embodiments, such sensors may be incorporated in other components of the washing machine 10. In particular, in some embodiments, the motor 16 may be used to perform the functions of the current sensor 24, load sensor 26, and ambient temperature sensor 28. As discussed above, the motor 16 may be used to determine the ambient temperature. In some embodiments, dynamic measurement of the motor 16 may be used to determine the amount of laundry and wash water inside of the drum 18. For example, the power consumed by the motor 16 can be used to estimate the mass of the load that is spinning. As another example, as the load is spinning, the load may be accelerated or decelerated by the motor 16. The torque of the motor 16 may be determined based on current consumption; given the torque and acceleration, the mass of the load may be determined.

The washing machine 10 includes a control panel 30, which is the user interface of the washing machine 10. The control panel 30 is configured to generate signals representative of a wash cycle program selected by the user. For example, the selected wash cycle program may specify fabric type, water temperature, and wash features (e.g., permanent press, delicate, rinse only, and the like). Thus, in some embodiments, rather than detecting fabric type with the load sensor 26, fabric type may be specified by the user using the control panel 30. The control panel 30 may be embodied as a plurality of knobs, switches, and other user controls. In some embodiments, the control panel 30 may be embodied as a touch screen interface. The control panel 30 is also electrically coupled to the controller 32.

As described briefly above, the washing machine 10 includes an electronic controller 32. The controller 32 is, in essence, the master computer responsible for interpreting electrical signals sent by controls and sensors of the washing machine 10, including the current sensor 24, the load sensor 26, and the ambient temperature sensor 28. The controller 32 is also responsible for activating or energizing electronically-controlled components associated with the inverter 14, the motor 16, and the heater 22. For example, the controller 32 is configured to control the various components of the washing machine 10 according to a selected wash cycle program. In particular, as will be described in more detail below with reference to FIGS. 2-5, the controller 32 is operable to model the wash cycle of the washing machine 10 and adapt the selected wash cycle program accordingly.

To do so, the controller 32 may include a number of electronic components commonly associated with electronic units utilized in the control of electromechanical systems. For example, the controller 32 may include, amongst other components customarily included in such devices, a processor such as a microprocessor 34 and a memory device 36. The microprocessor 34 may be any type of device capable of executing software or firmware, such as a microcontroller, microprocessor, digital signal processor, or the like. The memory device 36 may be embodied as one or more non-transitory, machine-readable media. The memory device 36 is provided to store, amongst other things, instructions in the form of, for example, a software routine (or routines) which, when executed by the microprocessor 34, allows the controller 32 to control operation of the washing machine 10.

The controller 32 also includes an analog interface circuit 38. The analog interface circuit 38 converts output signals (e.g., from the inverter 14) into signals which are suitable for presentation to an input of the microprocessor 34. In particular, the analog interface circuit 38, by use of an analog-to-digital (A/D) converter (not shown) or the like, converts analog signals into digital signals for use by the microprocessor 34. It should be appreciated that the A/D converter may be embodied as a discrete device or number of devices, or may be integrated into the microprocessor 34. It should be appreciated that if the inverter 14 (or any other sensor associated with the washing machine 10) generates a digital output signal, the analog interface circuit 38 may be bypassed.

Similarly, the analog interface circuit 38 converts signals from the microprocessor 34 into output signals which are suitable for presentation to the electrically-controlled components associated with the washing machine 10 (e.g., the inverter 14). In particular, the analog interface circuit 38, by use of a digital-to-analog (D/A) converter (not shown) or the like, converts the digital signals generated by the microprocessor 34 into analog signals for use by the electronically-controlled components associated with the washing machine 10. It should be appreciated that, similar to the A/D converter described above, the D/A converter may be embodied as a discrete device or number of devices, or may be integrated into the microprocessor 34. It should also be appreciated that if the inverter 14 (or any other electronically-controlled component associated with the washing machine 10) operates on a digital input signal, the analog interface circuit 38 may be bypassed. In some embodiments, the controller 32 may communicate with other devices on the electrical grid concerning electrical demand and usage through the AC mains power 50 or through another communications interface (not illustrated).

Figure 2:
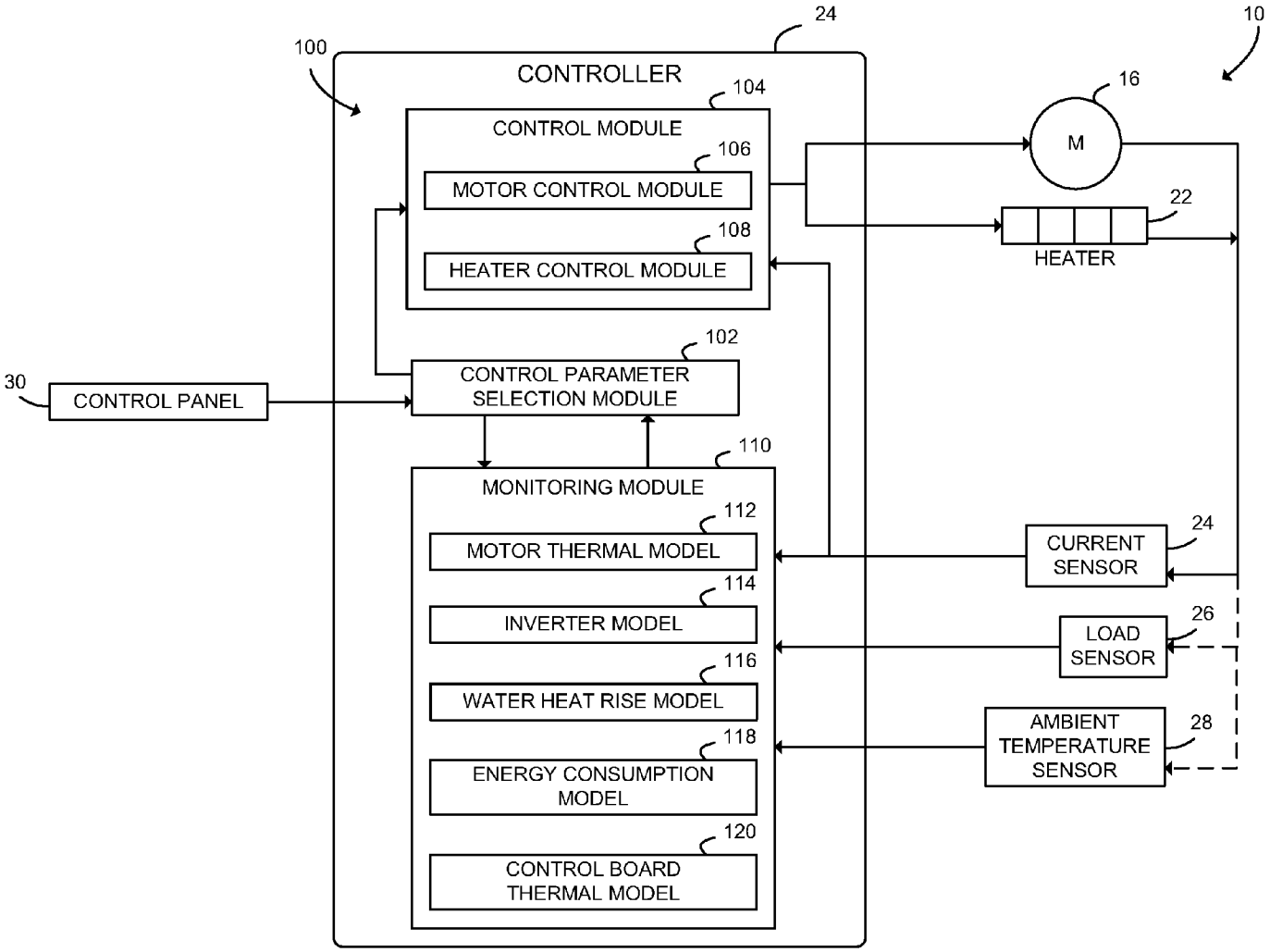
FIG. 2 is a simplified block diagram of an environment established by an electronic controller of the washing machine of FIG. 1.

Referring now to FIG. 2, the controller 32 establishes an environment 100 in use. The illustrative environment 100 includes a control parameter selection module 102, a control module 104, and a monitoring module 110. The various modules of the environment 100 may be embodied as hardware, firmware, software, or a combination thereof.

The control parameter selection module 102 is configured to receive the selected wash cycle program from the control panel 30. Based on the selected wash cycle program, the control parameter selection module 102 determines appropriate control parameters for various components of the washing machine 10. Such control parameters may be determined from one or more lookup tables embedded in the controller 32. The control parameter selection module 102 provides determined control parameters to the control module 104 and the monitoring module 106 and directs the control module 104 to begin operation of the washing machine.

The control module 104 includes conventional systems for controlling the motor 16 and the heater 22 of the washing machine 10. For example, the control module 104 may include a number of proportional-integral controllers. The control module 104 receives feedback directly from the current sensor 24. In other embodiments, the control module 104 may receive feedback from other sensors of the washing machine 10. In some embodiments, the motor 16 and the heater 22 may be controlled by sub-modules, for example, by a motor control module 106 and a heater control module 108.

The monitoring module 110 operates a plurality of system models of the washing machine 10. In addition to receiving the control parameters from the module 102, the monitoring module 110 receives other input data from the sensors of the washing machine 10, including the current sensor 24, the load sensor 26, and the ambient temperature sensor 28. Using this input data, the monitoring module 110 determines an operating condition of the washing machine 10 as the wash cycle progresses. As used herein, the term "operating condition" refers to any measured state during the wash cycle, and includes, for example, environmental conditions (i.e., ambient temperature, water temperature, motor electrical current, etc.) and other conditions of the washing machine 10. Based on the determined operating condition, the monitoring module 110 performs numerical simulations of the washing machine 10 to predict one or more operational parameters of the washing machine 10, as described in greater detail below. As used herein, the term "operational parameter" refers to any predicted parameter of the washing machine 10 or its components during the wash cycle. For example, based on the determined ambient temperature, the monitoring module 110 may simulate the temperature of the motor 16 throughout the entire wash cycle. In some embodiments, such simulations may be performed by sub-modules, for example, by a motor thermal model 112, an inverter model 114, a water heat rise model 116, an energy consumption model 118, and/or a control board thermal model 120. Of course, the monitoring module 110 may predict other operational parameters of the washing machine 10 and is not limited to those included in the illustrative embodiment.

The control parameter selection module 102 evaluates the predicted operational parameters and determines whether to adjust the control parameters of the selected wash cycle program. For example, if the monitoring module 110 determines that the motor temperature will be too high, the control parameter selection module 102 may modulate the working conditions of the motor 16 to reduce the motor temperature. The adjusted control parameters are then provided to the modules 104, 106, 108. As a result, the operation of the washing machine 10 may be adjusted.

Figure 3:
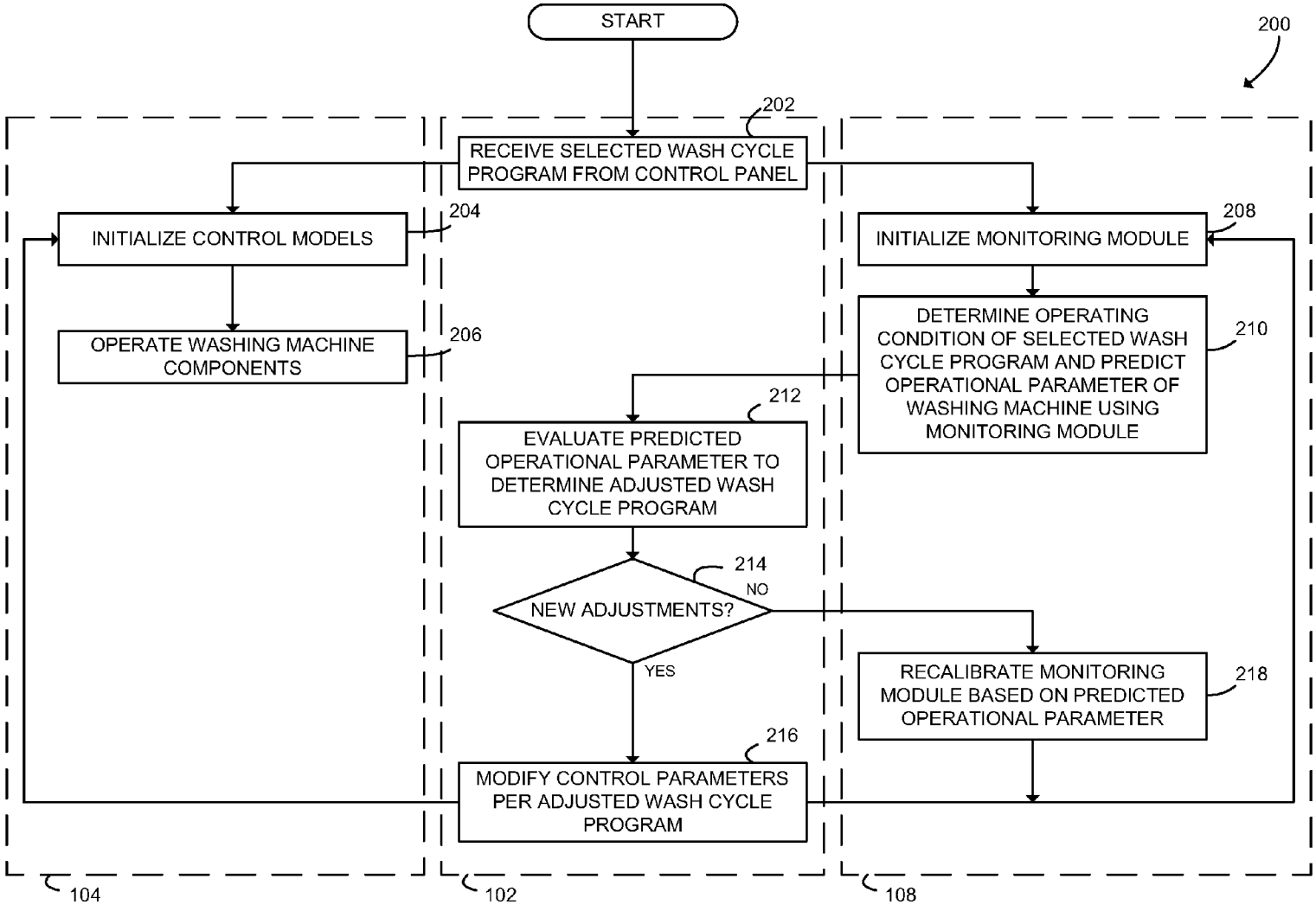
FIG. 3 is a simplified flow diagram of one embodiment of an algorithm for controlling the washing machine of FIG. 1.

Referring now to FIG. 3, an illustrative embodiment of a control routine 200 for the washing machine 10 is shown. The routine 200 is executed by the controller 32 (in conjunction with the inverter 14, the 22, and/or other sensors of the washing machine 10). The routine 200 commences with block 202 in which the controller 32 receives user input from the control panel 30 indicative of a selected wash cycle program. In the illustrative embodiment, the memory device 36 has a plurality of pre-programmed wash cycle programs stored therein. The controller 32 accesses the memory device 36 to retrieve the control parameters associated with the selected wash cycle program. After retrieving the control parameters 32, the routine 200 advances to blocks 204 and 208.

In block 204, the controller 32 initializes the control module 104 according to the selected wash cycle program. As part of initialization, appropriate initial control parameters are supplied to the control module 104. In block 206, the controller 32 operates the washing machine 10 according to the selected wash cycle program. For example, the controller 32 may activate both the motor 16 and the heater 22 during the washing operation of the wash cycle, activate the motor 16 during the rinse operation of the washing cycle, increase the speed of the motor 16 during the spin dry operation of the washing cycle, and so forth.

Referring now to block 208, the controller 32 initializes the monitoring module 110 according to the selected wash cycle program. This initialization occurs contemporaneously with block 204, in which the control module 104 is initialized. As described above, the monitoring module 110 is provided with the same control parameters as the control module 104 so that the monitoring module 110 is capable of simulating the actual operation of the washing machine 10. The routine 200 then advances to block 210 in which the controller 32 determines an operating condition of the washing machine 10 and predicts a value of an operational parameter of the washing machine 10, as described in greater detail below in regard to FIG. 4. The routine 200 may then advance to block 212.

In block 212, the controller 32 evaluates the predicted operational parameter to adjust wash cycle program. For example, if the value of the operational parameter is predicted to be outside of an operational limit during the wash cycle, the selected wash cycle program may be modified to keep the predicted operational parameter within the limit, as described below in connection with FIG. 5. The routine 200 may then advance to block 214.

In block 214, the controller 32 determines whether an adjusted wash cycle program was created in block 212. If an adjusted wash cycle program including new control parameters was created in block 212, the routine advances to block 216. If the wash cycle program was not adjusted, the routine 200 branches to block 218.

In block 216, the controller 32 modifies the selected wash cycle program according to the adjusted wash cycle program determined in block 212. To do so, the control parameter selection module 102 provides adjusted control parameters to the control module 104 and the monitoring module 108. After block 216, the routine 200 loops back to blocks 204 and 208 to re-initialize the control module 104 and the monitoring module 108. In block 204, the control module 104 is initialized with the newly adjusted control parameters, and the washing machine 10 is controlled according to the adjusted selected wash cycle program. In block 208, the monitoring module 110 is also initialized with the newly adjusted control parameters.

Referring back to block 214, if the wash cycle program was not adjusted, the routine 200 branches to block 218. In block 218, in some embodiments, the controller 32 recalibrates the monitoring module 110 based on the predicted operational parameters and the adjusted wash cycle program. The system model used by the monitoring module 110 is preconfigured for characteristics typical of a particular washing machine model. However, due to ordinary manufacturing variations, environmental conditions, and wear over time, the characteristics of the particular washing machine 10 may vary from the typical characteristics of the washing machine model. For example, the stator field coils of the motor 16 may have more or less resistance than is typical. To improve prediction accuracy, the system model may include tunable parameters that can be adjusted based on actual performance of the washing machine 10. This adjustment may be implemented using any technique to reduce deviation between the model prediction and actual performance. For example, the adjustment may be implemented using proportional-integral or proportional-integral-derivative controllers embedded in the controller 32, using a simulated neural network embedded in the controller 32, or using fixed rules to adjust the tunable parameters based on trial and error. After block 218, the routine 200 loops back to block 208 to re-initialize the monitoring module 110 and continue determining operating conditions and predicting operational parameters.

As illustrated in FIG. 3, blocks 204 and 206 execute in the control module 104, blocks 202, 212, 214, and 216 execute in the control parameter selection module 102, and blocks 208, 210, and 218 execute in the monitoring module 110. In the illustrative embodiment, these blocks execute contemporaneously on the controller 32 using at least three separate threads of execution. However, it should be understood that these blocks may be executed on the controller 32 sequentially or using a different concurrency method. Additionally, these blocks may be executed by any functional resources of the controller 32, including any combination of hardware, software, and firmware.

Figure 4:
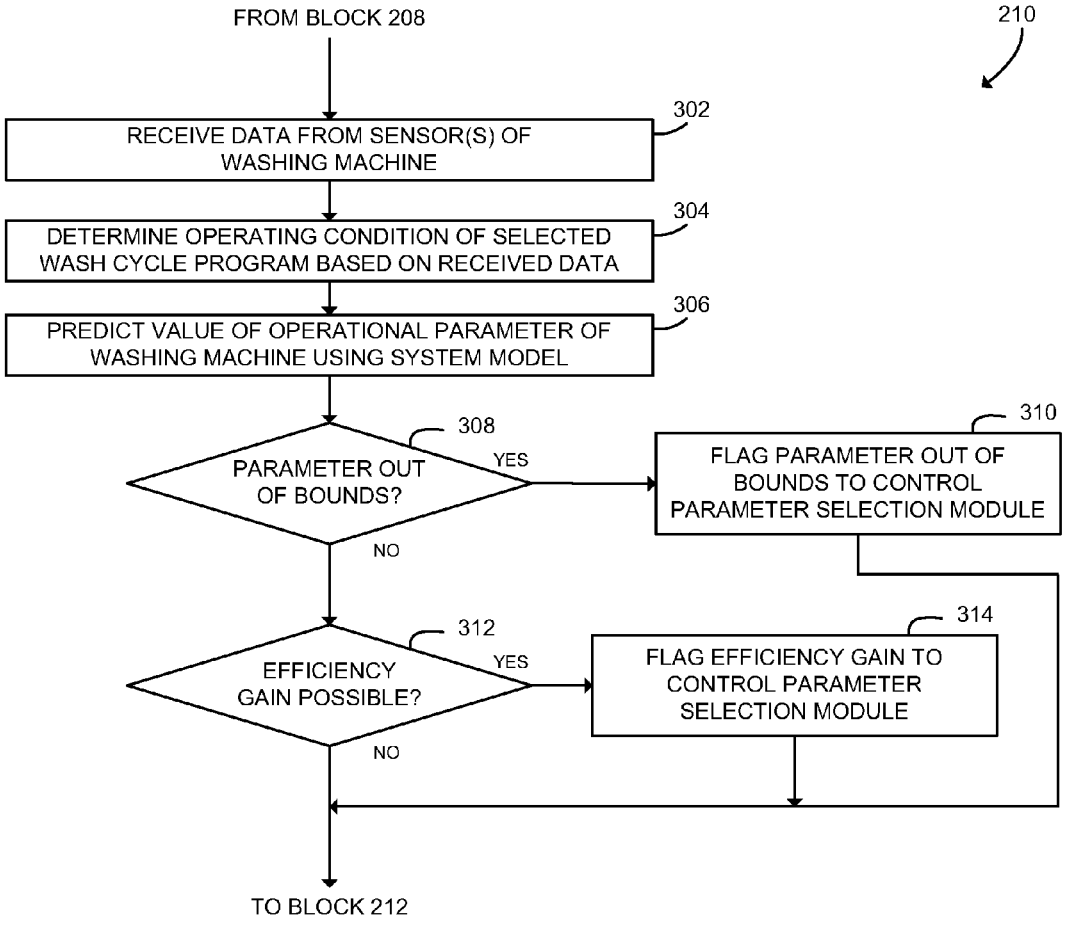
FIG. 4 is a simplified flow diagram of one embodiment of a subroutine for determining an operating condition and predicting an operational parameter of the washing machine of FIG. 1.

Referring now to FIG. 4, an illustrative embodiment of a control subroutine for block 210 of FIG. 3 is illustrated as a simplified flow diagram. In block 302, the controller 32 receives data from one or more sensors of the washing machine 10. Such data may include motor current data from the current sensor 24, load data from the load sensor 26, and ambient temperature data from the ambient temperature sensor 28.

In block 304, the controller 32 determines an operating condition of the washing machine 10 based on the sensor data received in block 302. The operating condition is any measured state during the wash cycle, and includes environmental conditions and conditions of the washing machine 10. Operating conditions include ambient temperature, wash load size, fabric type, and motor current draw. The operating condition may change as the wash cycle progresses. For example, ambient temperature may change during the wash cycle. In another example, the motor current draw may change due to a fault in the motor 16 during the wash cycle. Determining the operating condition as the wash cycle progresses allows the controller 32 to intelligently adapt the wash cycle.

In block 306, the controller 32 predicts the value of an operational parameter of the washing machine 10 using a system model of the washing machine 10. The system model performs numerical calculations to simulate the operational parameters of the washing machine 10 or its various components, based on the determined operating condition. The system model includes multiple sub-models simulating various aspects of the washing machine 10. For example, the motor thermal model 112 simulates the temperature of the motor 16 throughout the wash cycle. Based on the load size and the selected wash cycle program, the torque that will be produced by the motor 16 is predicted. Given the predicted motor torque, the temperature and the energy consumption of the motor 16 are predicted. Additional data input to the system model may improve the accuracy of the prediction. For example, the motor temperature may be more accurately predicted by also considering ambient temperature data. The motor thermal model 112 also predicts motor temperature based on input current into the motor 16. Such prediction can be used to detect unexpected conditions that could lead to failure.

Other operational parameters are modeled similarly. The inverter model 114 simulates the input current draw of the washing machine 10 throughout the wash cycle. Based on the load size, the ambient temperature, and the selected wash cycle program, the electrical current consumption of the washing machine 10 is predicted. The water heat rise model 116 simulates wash water temperature throughout the wash cycle based on the load size, the ambient temperature, and the selected wash cycle program. The energy consumption model 118 simulates energy consumed by the washing machine 10 throughout the wash cycle based on the load size, the ambient temperature, and the selected wash cycle program. The control board thermal model 120 simulates the temperature of the control board of the washing machine 10 through the wash cycle. As described above, the control board includes components that regulate and supply power to the motor 16, including components of the AC-DC converter 12 and/or the inverter 14. The control board temperature is simulated based on the load size, ambient temperature, the selected wash cycle program, and the electrical current consumption of the motor 16. In particular, the control board temperature is simulated based on the phase current of the motor 16, that is, the current flowing through any one of the stator field coils of the motor 16.

In block 308, the controller 32 determines whether the value of the operational parameter predicted in block 306 is outside of predefined bounds. The predefined bounds represent safety- or reliability-based limits on operational parameters of the washing machine 10 or its components. For example, the motor 16 has a maximum safe temperature for operation. As another example, the washing machine 10 has a maximum safe current consumption that it may draw from the AC mains power 50. As another example, the control board has a maximum safe temperature for operation. Exceeding any of these limits lead to reduced reliability or safety hazards. If the value of the operational parameter is out of bounds, the subroutine 210 advances to block 310. If the value of the operational parameter is not out of bounds, the subroutine 210 advances to block 312.

In block 310, the controller 32 sets a flag to indicate that a predicted operational parameter is out of bounds. The flag is accessible by the control parameter selection module 102. In some embodiments, the flag also indicates the particular operational parameter that is out of bounds, e.g., the current draw or the motor temperature. The flag is implemented as a hardware register of the controller 32. In other embodiments, the flag may be implemented as a semaphore, a data packet, or other suitable communication facility. After setting the flag, the subroutine 210 returns.

Referring back to block 308, if the operational parameter is not out of bounds, the subroutine 210 advances to block 312. In block 312, the controller 32 determines, based on the predicted operational parameter, whether the efficiency of the washing machine 10 can be improved to reach an efficiency goal. Efficiency includes energy efficiency and washing efficiency. Considering energy efficiency, the energy consumption of the motor 16 and the heater 22 may be reduced to meet an energy consumption goal. For example, when the predicted wash water temperature exceeds a target water temperature needed for acceptable cleaning, as when there is high ambient temperature, the energy consumed by the heater 22 may be reduced. In another example, the energy consumption goal may depend on whether energy is in high demand from the electrical grid. Considering cleaning efficiency, given that the operational parameters are not out of bounds, the wash temperature or the wash cycle time may be adjusted to improve cleaning effectiveness. If an efficiency gain is not possible, the subroutine 210 returns. If an efficiency gain is possible, the subroutine 210 advances to block 314.

In block 314, the controller 32 sets a flag to indicate that an efficiency gain is possible. The flag is accessible by the control parameter selection module 102. In some embodiments, the flag also indicates the particular efficiency gain that is possible, e.g., motor power consumption or heater power consumption. The flag is implemented as a hardware register of the controller 32. In other embodiments, the flag may be implemented as a semaphore, a data packet, or other suitable communication facility. After setting the flag, the subroutine 210 returns.

Figure 5:
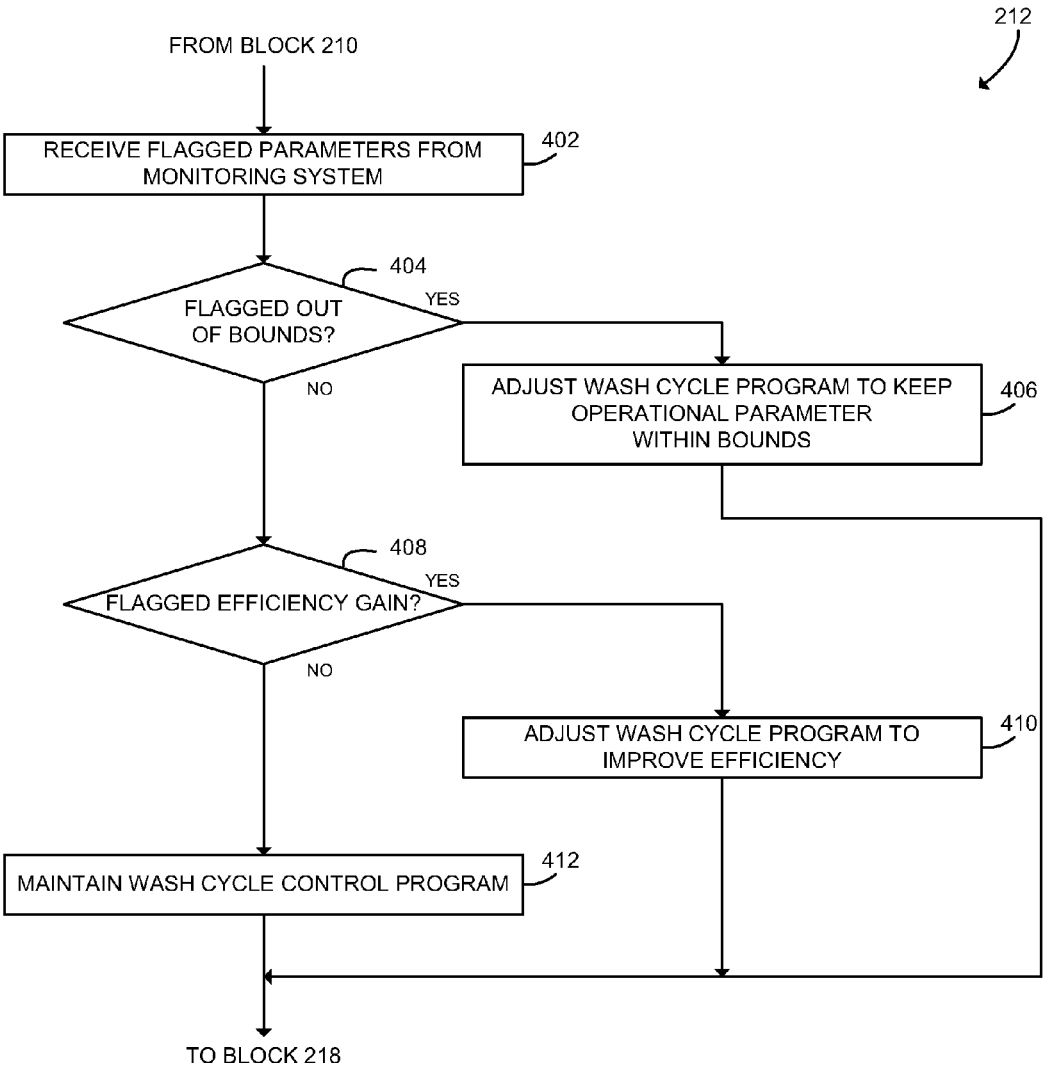
FIG. 5 is a simplified flow diagram of one embodiment of a subroutine for adjusting the wash cycle of the washing machine of FIG. 1 based on the predicted operational parameter.

Referring now to FIG. 5, an illustrative embodiment of a control subroutine for block 212 of FIG. 3 is illustrated as a simplified flow diagram. In block 402, the controller 32 receives any flags set by the monitoring module 110 in blocks 310 and 314. As described in more detail above, the flags are hardware registers of the controller 32, but may be implemented as any suitable communication facility.

In block 404, the controller 32 determines whether the parameter out of bounds flag is set. If the flag is not set, then the subroutine 212 advances to block 408. If the flag is set, the subroutine 212 advances to block 406.

In block 406, the controller 32 adjusts the selected wash cycle program to keep the predicted operational parameter in bounds. The controller 32 selects adjustments to the wash cycle from a table of possible adjustments, based on the out-of-bounds operational parameter. For example, if the predicted motor temperature is out of bounds, the controller 32 adjusts the duty cycle of the motor 16 to reduce the predicted motor temperature. The duty cycle of the motor 16 can be adjusted by modifying the selected wash cycle program to reduce the proportion of time when the motor 16 is activated. Alternatively, the duty cycle of the motor 16 can be adjusted through pulse-width modulation of the input current produced by the inverter 14. As another example, if the predicted control board temperature is out of bounds, the controller 32 adjusts the duty cycle of the motor 16 to reduce the predicted control board temperature. Such duty cycle adjustments are similar to the adjustments to reduce the predicted motor temperature. As another example, if the predicted current consumption of the washing machine 10 is out of bounds, the duty cycle of the motor 16 or the heater 22 may be adjusted. Similar to the motor 16, the duty cycle of the heater 22 can be adjusted by modifying the on- and off-time of the heater 22 or by pulse-width modulation of the input current produced by the inverter 14. Although described as performing a table lookup to determine the adjusted wash cycle program, in some embodiments the controller 32 may calculate the adjusted wash cycle program analytically. In some embodiments, the controller 32 may use the system model of the monitoring module 110 to perform those analytical calculations. The adjusted wash cycle program is used by the controller 32 to continue operating the washing machine 10, by supplying adjusted control parameters to the control module 104. After adjusting the selected wash cycle program, the subroutine 212 returns.

Referring back to block 404, if the flag indicating an operational parameter is out of bounds is not set, then the subroutine 212 advances to block 408. In block 408, the controller 32 determines whether the efficiency gain flag is set. If the flag is not set, then the subroutine 212 advances to block 412. If the flag is set, the subroutine 212 advances to block 410.

In block 410, the controller 32 adjusts the selected wash cycle program to improve efficiency. Again, the controller 32 selects adjustments to the wash cycle from a table of possible adjustments, based on the potential efficiency gain. For example, the motor energy consumption may be reduced to meet an efficiency goal by adjusting the duty cycle of the motor 16, as described above. In another example, when cleaning efficiency may be improved, the wash cycle program may be adjusted to increase water heat rise or increase time spent rotating the motor 16. In another example, when water heat rise may be reduced and still achieve the target wash water temperature, the duty cycle of the heater 22 may be adjusted, as described above. Although described as performing a table lookup to determine the adjusted wash cycle program, in some embodiments the controller 32 may calculate the adjusted wash cycle program analytically. In some embodiments, the controller 32 may use the system model of the monitoring module 110 to perform those analytical calculations. The controller 32 may optimize the wash cycle program by performing repeated simulations of the wash cycle to search for the best adjusted wash cycle program. For example, the controller 32 may determine through repeated simulations an adjusted wash cycle program that achieves the target wash water temperature while consuming the least amount of energy. The available processing time and memory space of the controller 32 may determine the level of optimization performed. The adjusted wash cycle program is used by the controller 32 to continue operating the washing machine 10, supplying adjusted control parameters to the control module 104. After adjusting the selected wash cycle program, the subroutine 212 returns.

Referring back to block 408, if the efficiency gain flag is not set, then the subroutine 212 advances to block 412. In block 412, the controller 32 maintains the current selected wash cycle program. The controller 32 maintains the current selected wash cycle program by supplying unchanged control parameters to the control module 104. In other embodiments, the controller 32 may maintain the current wash cycle program by doing nothing. After maintaining the current wash cycle program, the subroutine 212 returns.

As an example, in operation the user of the washing machine 10 selects a wash cycle program using the control panel 30. The controller 32 initializes the control module 104 and the monitoring module 110 based on the selected wash cycle program, and the washing machine 10 starts the wash cycle. During the wash cycle, the monitoring module 110 determines the amount of laundry in the washing machine 10 based on load data received from the load sensor 26. Based on the selected wash cycle and the amount of laundry, the monitoring module 110 predicts the motor temperature during the wash cycle. The control parameter selection module 102 evaluates the predicted motor temperature to determine whether the maximum safe motor temperature will be exceeded. If so, the parameter selection module 102 adjusts the duty cycle of the motor 16 for the remainder of the selected wash cycle program to reduce the predicted motor temperature to below the maximum safe motor temperature. The adjusted wash cycle program is forwarded to the control module 104, which operates the washing machine 10 according to the adjusted wash cycle program. As another example, the monitoring module 110 may predict the motor temperature during the wash cycle based on the selected wash cycle, the amount of laundry, and the ambient temperature determined from ambient temperature data received from the ambient temperature sensor 28. As a different example, the monitoring module 110 may predict the motor temperature during the wash cycle based on current consumption of the motor 16 determined from data received from the current sensor 24.

As another example, in operation the user of the washing machine 10 selects a wash cycle program using the control panel 30. The controller 32 initializes the control module 104 and the monitoring module 110 based on the selected wash cycle program, and the washing machine 10 starts the wash cycle. During the wash cycle, the monitoring module 110 determines the current consumption of the motor 16 determined from data received from the current sensor 24. Based on the current consumption of the motor 16, the monitoring module 110 predicts the control board temperature during the wash cycle. The control parameter selection module 102 evaluates the predicted control board temperature to determine whether the maximum safe control board temperature will be exceeded. If so, the parameter selection module 102 adjusts the duty cycle of the motor 16 for the remainder of the selected wash cycle program to reduce the predicted control board temperature to below the maximum safe control board temperature. The adjusted wash cycle program is forwarded to the control module 104, which operates the washing machine 10 according to the adjusted wash cycle program.

As another example, in operation the user of the washing machine 10 selects a wash cycle program using the control panel 30. The controller 32 initializes the control module 104 and the monitoring module 110 based on the selected wash cycle program, and the washing machine 10 starts the wash cycle. During the wash cycle, the monitoring module 110 determines the amount of laundry in the washing machine 10 based on load data received from the load sensor 26. The monitoring module 110 also determines the ambient temperature based on ambient temperature data received from the ambient temperature sensor 28. Based on the selected wash cycle, the amount of laundry, and the ambient temperature, the monitoring module 110 predicts the electrical current consumed by the washing machine during the wash cycle. The control parameter selection module 102 evaluates the predicted current consumption to determine whether the maximum current consumption will be exceeded. If so, the parameter selection module 102 adjusts the duty cycle of the motor 16 and the heater 22 to reduce the predicted current consumption below the maximum safe current consumption. The adjusted wash cycle program is forwarded to the control module 104, which operates the washing machine 10 according to the adjusted wash cycle program.

As another example, in operation the user of the washing machine 10 selects a wash cycle program using the control panel 30. The controller 32 initializes the control module 104 and the monitoring module 110 based on the selected wash cycle program, and the washing machine 10 starts the wash cycle. During the wash cycle, the monitoring module 110 determines the amount of laundry in the washing machine 10 based on load data received from the load sensor 26. The monitoring module 110 also determines the ambient temperature based on ambient temperature data received from the ambient temperature sensor 28. Based on the selected wash cycle, the amount of laundry, and the ambient temperature, the monitoring module 110 predicts the heat rise produced by the heater 22 during the wash cycle. The control parameter selection module 102 evaluates the predicted heat rise to determine if the predicted water heat rise can be reduced to a target water heat rise that provides acceptable cleaning effectiveness. If so, the parameter selection module 102 adjusts the duty cycle of the heater 22 for the remainder of the selected wash cycle program to reduce the predicted water heat rise to the target water heat rise. The adjusted wash cycle program is forwarded to the control module 104, which operates the washing machine 10 according to the adjusted wash cycle program. In another example, the control parameter selection module 102 evaluates the predicted heat rise to determine if the predicted water heat rise should be increased to reach the target water heat rise (for example, when the ambient temperature is cold). If so, the parameter selection module 102 adjusts the duty cycle of the heater 22 for the remainder of the selected wash cycle program to increase the predicted water heat rise to the target water heat rise. The adjusted wash cycle program is forwarded to the control module 104, which operates the washing machine 10 according to the adjusted wash cycle program. In future iterations, the parameter selection module 102 may adjust the wash cycle to reduce the predicted current consumption below the maximum current consumption, as described above.

Figure 6:
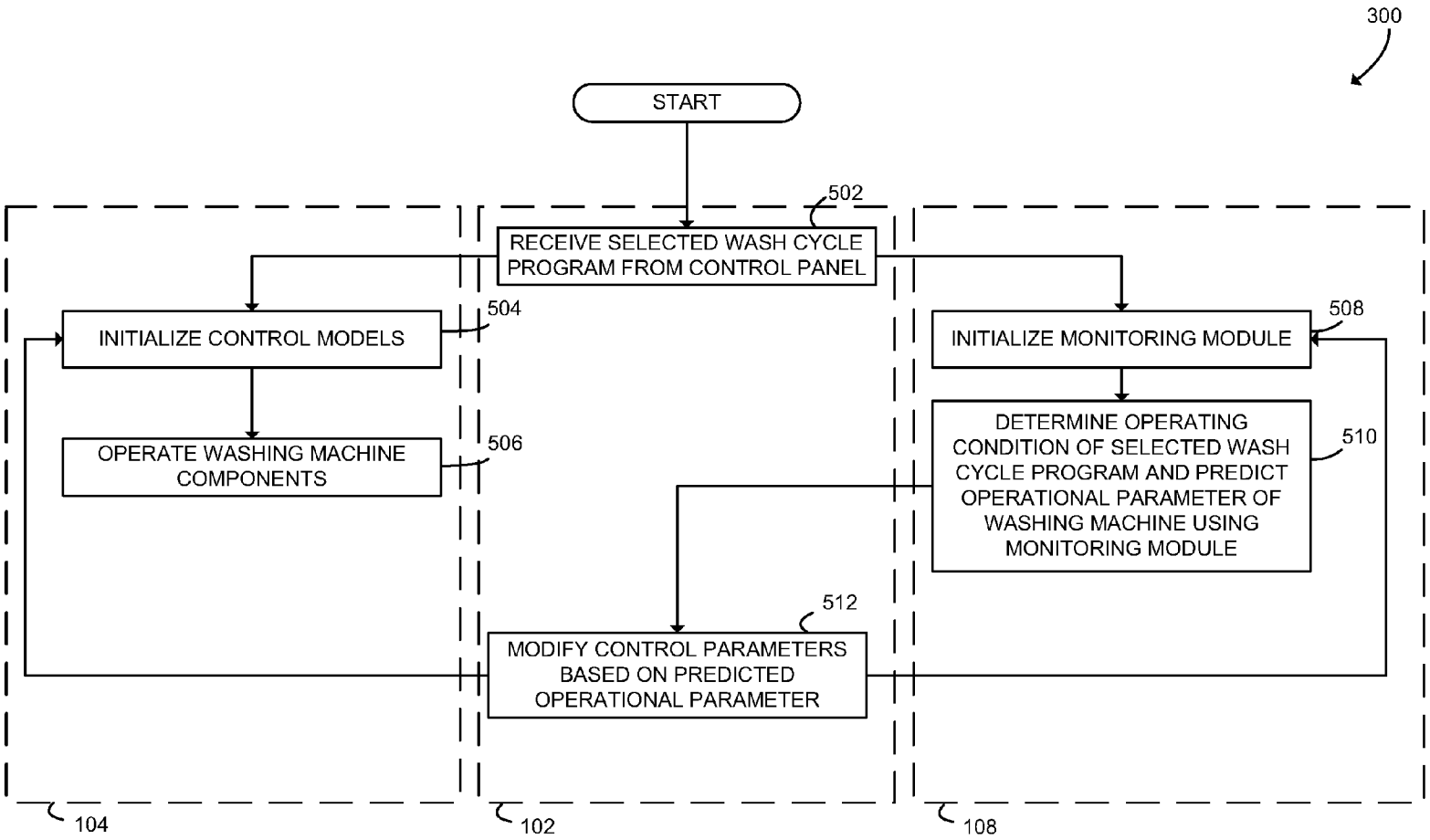
FIG. 6 is a simplified flow diagram of one embodiment of an algorithm for controlling the washing machine of FIG. 1.

Referring now to FIG. 6, an illustrative embodiment of a control routine 300 for the washing machine 10 is shown. The routine 300 is executed by the controller 32 (in conjunction with the inverter 14, the 22, and/or other sensors of the washing machine 10). The routine 300 commences with block 502 in which the controller 32 receives user input from the control panel 30 indicative of a selected wash cycle program. In the illustrative embodiment, the memory device 36 has a plurality of pre-programmed wash cycle programs stored therein. The controller 32 accesses the memory device 36 to retrieve the control parameters associated with the selected wash cycle program. After retrieving the control parameters 32, the routine 200 advances to blocks 504 and 508.

In block 504, the controller 32 initializes the control module 104 according to the selected wash cycle program. As part of initialization, appropriate initial control parameters are supplied to the control module 104. In block 506, the controller 32 operates the washing machine 10 according to the selected wash cycle program. For example, the controller 32 may activate both the motor 16 and the heater 22 during the washing operation of the wash cycle, activate the motor 16 during the rinse operation of the washing cycle, increase the speed of the motor 16 during the spin dry operation of the washing cycle, and so forth.

Referring now to block 508, the controller 32 initializes the monitoring module 110 according to the selected wash cycle program. This initialization occurs contemporaneously with block 504, in which the control module 104 is initialized. As described above, the monitoring module 110 is provided with the same control parameters as the control module 104 so that the monitoring module 110 is capable of simulating the actual operation of the washing machine 10. The routine 300 then advances to block 510 in which the controller 32 determines an operating condition of the washing machine 10 and predicts a value of an operational parameter of the washing machine 10, as described in greater detail above in regard to FIG. 4. The controller 32 may recalibrate the monitoring module 110 based on the predicted operating parameter, as described in detail above in regard to block 218 of FIG. 3. After block 510, the routine 300 advances to block 512.

In block 512, the controller 32 modifies the control parameters based on the predicted value of the operational parameter. The modified control parameters are provided to the control module 104 and the monitoring module 108. For example, the monitoring module 110 may predict the resistance of the stator field coils of the motor 16. In turn, the controller 32 updates the control parameters of the control module 104 based on the predicted resistance as the wash cycle progresses, without stopping rotation of the motor 16 to measure resistance. As another example, the monitoring module 110 may predict the magnetic flux produced in the motor 16, which may be determined based on the motor temperature. Note that in contrast to the routine 200, the controller 32 need not evaluate the operational parameter to determine an adjusted wash cycle program. After block 512, the routine 300 loops back to blocks 504 and 508 to re-initialize the control module 104 and the monitoring module 108.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A method for controlling operation of a washing machine during a wash cycle, comprising:

receiving a selected wash cycle program of a plurality of pre-programmed wash cycles, operating the washing machine in accordance with the selected wash cycle program, determining an operating condition when operating the washing machine in accordance with the selected wash cycle program, simulating the selected wash cycle program based on the operating condition to predict a value of an operational parameter of the washing machine, wherein simulating the selected wash cycle program comprises (i) determining a predicted operating temperature of a washing machine motor and (ii) determining whether the predicted operating temperature exceeds a maximum temperature of the motor, adjusting the selected wash cycle program based on the predicted value of the operational parameter, wherein adjusting the selected wash cycle program comprises modifying a duty cycle of the motor to lower the predicted operating temperature of the motor to below the maximum temperature of the motor, and operating the washing machine in accordance with the adjusted wash cycle program.

2. The method of claim 1, wherein:

determining the operating condition of the selected wash cycle program comprises receiving data from a sensor of the washing machine, simulating the selected wash cycle program comprises (i) determining a predicted value of the operational parameter based on the received data, and (ii) determining whether the predicted value of the operational parameter is within an accepted operational range of the washing machine, and adjusting the selected wash cycle program comprises (i) modifying the selected wash cycle program when the predicted value of the operational parameter is outside of the accepted operational range, and (ii) maintaining the selected wash cycle program when the predicted value of the operational parameter is within the accepted operational range.

3. The method of claim 2, wherein (i) simulating the selected wash cycle program further comprises determining whether the predicted value of the operational parameter can be modified to meet an efficiency goal when the predicted value is within the accepted operational range, and (ii) modifying the selected wash cycle program to improve performance related to the efficiency goal when the predicted value can be modified to meet the efficiency goal.

4. The method of claim 3, wherein determining a predicted value of the operational parameter based on the received data includes determining a predicted energy consumption of a washing machine motor, and modifying the selected wash cycle program includes modifying a duty cycle of the motor to reduce the predicted energy consumption of the motor.

5. The method of claim 3, wherein:

receiving data from the sensor of the washing machine includes (i) receiving ambient temperature data from a temperature sensor of the washing machine, and (ii) receiving load data for the washing machine, determining the predicted value of the operational parameter includes determining a predicted cleaning effectiveness of the selected wash cycle program based on the ambient temperature data and the load data, and modifying the selected wash cycle program further includes modifying the selected wash cycle program to increase the predicted cleaning effectiveness of the selected wash cycle program.

6. The method of claim 3, wherein:

receiving data from the sensor of the washing machine includes (i) receiving ambient temperature data from a temperature sensor of the washing machine, and (ii) receiving load data for the washing machine, predicting the value of the operational parameter includes determining a predicted water heat rise produced by a heater of the washing machine based on the ambient temperature data and the load data, and modifying the selected wash cycle program includes modifying a duty cycle of the heater to reduce the predicted water heat rise.

7. The method of claim 3, further comprising optimizing the selected wash cycle program by:

simulating the selected wash cycle program for a first time period of the wash cycle, modifying the selected wash cycle program to produce a first modified wash cycle program, simulating the first modified wash cycle program for a second time period of the wash cycle, the second time period after the first time period, and modifying the first modified wash cycle program to produce a second modified wash cycle program.

8. The method of claim 2, wherein receiving data from the sensor of the washing machine includes receiving load data, and determining the predicted operating temperature of the motor includes predicting the operating temperature based on the load data and the selected wash cycle program.

9. The method of claim 8, wherein receiving data from the sensor further includes receiving ambient temperature data from a temperature sensor of the washing machine, and determining the predicted operating temperature of the motor includes predicting the operating temperature based on the load data, the selected wash cycle program, and the ambient temperature data.

10. The method of claim 1, wherein receiving data from the sensor includes receiving electrical current consumption data for the motor, and determining the predicted operating temperature of the motor includes predicting the operating temperature based on the electrical current consumption data.

11. The method of claim 1, further comprising recalibrating a system model based on the received data, the predicted value of the operational parameter, and the adjusted wash cycle program to reduce a prediction error of the system model using one of a proportional-integral controller, a proportional-integral-derivative controller, and a simulated neural network embedded in the washing machine.

12. The method of claim 1, wherein adjusting the selected wash cycle program based on the predicted value of the operational parameter comprises operating a controller to automatically adjust the selected wash cycle program based on the predicted value of the operational parameter.

13. A method for controlling operation of a washing machine during a wash cycle, comprising:

receiving a selected wash cycle program of a plurality of pre-programmed wash cycles, operating the washing machine in accordance with the selected wash cycle program, determining an operating condition when operating the washing machine in accordance with the selected wash cycle program, simulating the selected wash cycle program based on the operating condition to predict a value of an operational parameter of the washing machine wherein simulating the selected wash cycle program comprises (i) determining a predicted electrical current consumption of the washing machine and (ii) determining whether the predicted electrical current consumption exceeds a maximum electrical current consumption of the washing machine, determining whether the predicted value of the operational parameter exceeds an efficiency goal of the washing machine, adjusting the selected wash cycle program based on the predicted value of the operational parameter when the predicted value exceeds the efficiency goal wherein adjusting the selected wash cycle program comprises modifying at least one of (i) a duty cycle of a washing machine motor, and (ii) a duty cycle of a heater of the washing machine to lower the predicted electrical current consumption to below the maximum electrical current consumption of the washing machine, and operating the washing machine in accordance with the adjusted wash cycle program.

14. The method of claim 13, wherein adjusting the selected wash cycle program based on the predicted value of the operational parameter comprises operating a controller to automatically adjust the selected wash cycle program based on the predicted value of the operational parameter.

15. A method for controlling operation of a washing machine during a wash cycle, comprising:

receiving a selected wash cycle program of a plurality of pre-programmed wash cycles, operating the washing machine in accordance with the selected wash cycle program, determining an operating condition when operating the washing machine in accordance with the selected wash cycle program, simulating the selected wash cycle program based on the operating condition to predict a value of an operational parameter of the washing machine, wherein simulating the selected wash cycle program comprises (i) determining a predicted operating temperature of a washing machine control board and (ii) determining whether the predicted operating temperature exceeds a maximum safe temperature of the control board;

adjusting the selected wash cycle program based on the predicted value of the operational parameter, wherein adjusting the selected wash cycle program comprises modifying a duty cycle of the motor to lower the predicted operating temperature of the control board to below the maximum safe temperature of the control board; and operating the washing machine in accordance with the adjusted wash cycle program.

* * * * *